United States Patent [19]

Kent

[11] Patent Number: 4,934,017

[45] Date of Patent: Jun. 19, 1990

[54] MODULAR VACUUM CLEANING SYSTEM

[75] Inventor: Willie D. Kent, Clovis, Calif.

[73] Assignee: Rug Doctor, Inc., Fresno, Calif.

[21] Appl. No.: 107,886

[22] Filed: Oct. 9, 1987

Related U.S. Application Data

[63] Continuation of Ser. No. 755,925, Jul. 17, 1985, abandoned.

[51] Int. Cl.[5] ..... A47L 5/36; A47L 7/00; A47L 9/22

[52] U.S. Cl. ..... 15/321; 15/328; 15/413

[58] Field of Search ..... 15/353, 328, 413, 320, 15/321, 322, 327 D, 412

[56] References Cited

U.S. PATENT DOCUMENTS

| | | | |
|---|---|---|---|
| 2,533,395 | 12/1950 | Paine | 15/353 X |
| 2,785,767 | 3/1957 | Glidden | 15/353 X |
| 3,079,626 | 3/1963 | Yonkers et al. | 15/320 |
| 3,165,774 | 1/1965 | Barba | 15/353 X |
| 3,206,787 | 9/1965 | Daniels et al. | 15/353 X |
| 4,114,231 | 9/1978 | Nauta | 15/413 |
| 4,123,818 | 11/1978 | Hurwitz | 15/321 |
| 4,179,768 | 12/1979 | Sawyer | 15/353 X |
| 4,218,805 | 8/1980 | Brazier | 15/353 X |
| 4,226,000 | 10/1980 | Tribolet | 15/321 |
| 4,287,635 | 9/1981 | Jacobs | 15/321 |
| 4,287,636 | 9/1981 | Brazier | 15/321 |
| 4,458,377 | 7/1984 | Frohbieter | 15/321 X |
| 4,531,257 | 7/1985 | Passien | 15/321 |
| 4,654,926 | 4/1987 | McCambridge | 15/353 X |

*Primary Examiner*—Harvey C. Hornsby
*Assistant Examiner*—Scott J. Haugland
*Attorney, Agent, or Firm*—Schlemmer Dalton Associates

[57] ABSTRACT

A multiple function, modular vacuum cleaning system is described having a vacuum head which is releasably mounted on a waste recovery tank to form a first, portable wet/dry vacuum cleaning machine. The wet/dry vacuum cleaning machine in turn can be mounted on a cleaning solution tank to provide a second portable machine having wet extraction as well as wet and dry vacuum capabilities.

3 Claims, 6 Drawing Sheets

MODULAR VACUUM CLEANING SYSTEM

This is a continuation, of application Ser. No. 755,925 filed July 17, 1985, now abandoned.

BACKGROUND OF THE INVENTION

The present invention relates generally to the field of portable vacuum cleaning machines and to wet/dry vacuuming and wet extraction cleaning machines. The particular invention is a vacuum cleaning system in which two of three units of a portable self-contained wet extraction vacuum cleaning machine are separable into a separate wet/dry vacuum cleaning machine.

As used here, "dry vacuuming" involves the application of vacuum suction by an applicator tool to lift dirt and debris from a surface for transfer in a vacuum hose to a temporary storage container.

"Wet vacuuming" also involves the use of vacuum pick up, but in a system which has sufficient suction lift capability and water tight construction to lift and transfer the liquid and debris, typically to a temporary storage tank.

"Hydro-extraction" or "wet" extracting involves the application of a high pressure stream or jet of liquid such as an aqueous emulsifying solution to a surface and simultaneously or subsequently applying a wet vacuuming operation to pick up and transfer the debris and spent cleaning solution to a temporary storage tank. State-of-the-art machines mount the cleaning liquid nozzle on the vacuum pick-up head and the same applicator tool to facilitate the wet extraction operation.

Various portable and central vacuum cleaning machines exist which will perform one or more vacuum cleaning functions such as those defined above. For example, the ACS Model 831 built-in System and the ACS Model 431 self-contained System which are available from the Automated Cleaning Systems Division of Rug Doctor, Inc. of Fresno, California perform a number of cleaning functions, including wet and dry vacuuming, wet cleaning, wet extraction and hot/cold pressure washing. In addition, the R-150 and VH-175 vacuum cleaning machines available from the same source are self-contained, portable vacuum cleaning machines that are capable of wet and dry vacuuming and wet extraction.

Portable vacuum cleaning machines have also been designed having components that are interchangeable or selectively used. For example, U.S. Pat. No. 4,123,818, issued Nov. 7, 1978 to Hurwitz, discloses a vacuum cleaning system which has an add-on annular cleaning solution tank. U.S. Pat. No. 3,079,626, issued Mar. 5, 1963 to Yonkers, discloses a combination vacuum cleaning machine which includes a vacuum motor unit, and a vacuum cleaning unit which is interchangeable with a floor scrubbing unit.

Frohbieter, U.S. Pat. No. 4,458,377, issued July 10, 1984, shows a vacuum cleaning system having a housing with an upper nozzle that is adapted to receive a suction fan. The suction fan may be removed from the housing and attached to a separate dry vacuum canister or to a separate wet/dry vacuum canister.

U.S. Pat. No. 4,287,636, issued Sept. 8, 1981 to Brazier, discloses a system that can be used as a wet extractor or as a dry vacuum machine by the interchangeable use of a wet reservoir unit or a simple connector unit. These units are mounted between the tank and the vacuum head.

U.S. Pat. No., 4,226,000, issued Oct. 7, 1980 to Tribolet, discloses a wet/dry vacuum system in which a water recovery tank is connected in tandem with a vacuum canister. Alternatively, the recovery tank can be mounted on the canister. A stationary cleaning solution tank is connected to a source of tap water to supply cleaning solution to a hand-held cleaning tool. The vacuum generated by the vacuum canister and the recovery tank pick up the spent cleaning solution via the hand tool and transfer the spent solution to the recovery tank.

Thus, while vacuum systems employing interchangeable parts are known and while Tribolet discloses tandem and piggy-back versions of a portable wet extraction machine, to date, to my knowledge no one has developed a portable modular system of replaceable components that can be selectively combined to provide different, self-contained fully portable vacuum cleaning machines.

SUMMARY OF THE INVENTION

In view of the above discussion, it is one object of the present invention to provide a portable, self-contained, modular wet extraction vacuum cleaning system, the units of which can be separated to provide a second portable self-contained, modular vacuum cleaning machine that performs wet and dry vacuuming functions.

In one aspect, the present invention is a multiple function vacuum cleaning machine which comprises a top vacuum head, a waste recovery tank and a bottom cleaning solution storage tank. The vacuum head and waste recovery tank can be separated from the chemical cleaning solution storage tank to form a separate self-contained portable vacuum cleaning machine.

In another aspect, the present invention relates to a group of components which can be assembled selectively to form a self-contained portable two-unit wet/dry vacuum cleaning machine or a self-contained portable three-unit wet/dry/wet extraction vacuum cleaning machine. The units used are: first, a wet/dry recovery tank for receiving wet and dry debris and liquid from a cleaning tool; second, a vacuum head which is removably mounted on the waste recovery tank for applying vacuum suction to the waste recovery tank, and, which, together with the waste recovery tank forms a portable wet/dry vacuum cleaning machine; and, third, a self-contained chemical cleaning solution storage and pressurized dispensing tank that is releasably mounted to the bottom of the waste recovery tank and converts the two-unit cleaning machine to the three-unit cleaning machine.

In still another aspect, the vacuum head comprises vacuum blower means having a cooling fan mounted on the vacuum blower, and a vacuum blower inlet for connection to the waste recovery tank. The cooling fan has an upper air inlet and a lower air exhaust. The vacuum head also includes (a) cooling air inlet and outlet openings and at least one vacuum air flow exhaust outlet; (b) an enclosure surrounding the vacuum blower for directing discharge air to the vacuum air flow exhaust opening; and (c) a second enclosure connecting the vacuum head cooling air inlet and the fan cooling air inlet and separating the vacuum head cooling air inlet and the fan cooling air inlet from the vacuum head cooling air outlet, to thereby define separate vacuum air flow and cooling air flow paths within the vacuum head.

BRIEF DESCRIPTION OF THE DRAWINGS

The above and other aspects of the present invention are described in more detail in conjunction with the drawings, in which.

DETAILED DESCRIPTION OF THE INVENTION

Overview

Figure 1:
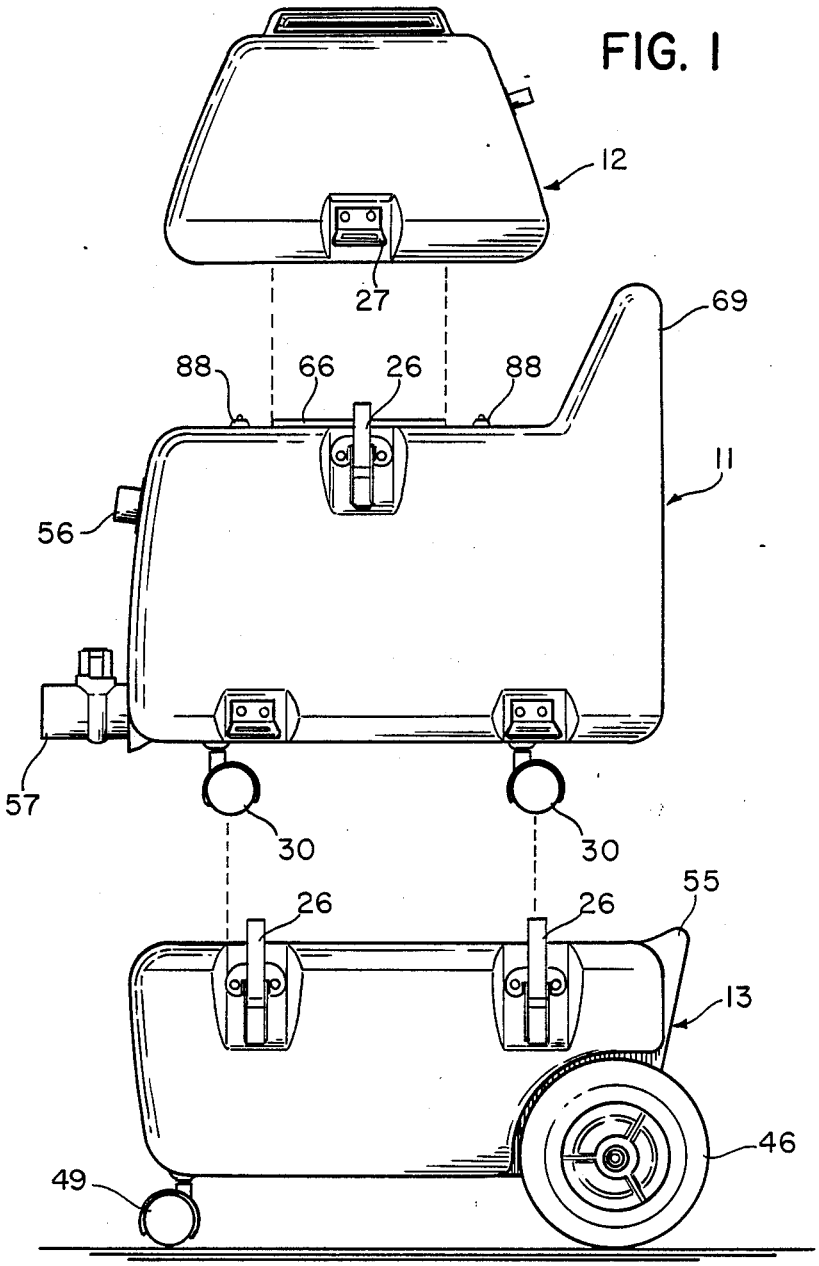
FIG. 1 is an exploded side elevational view of a preferred embodiment of the vacuum cleaning system of the present invention, showing the mounting relationships of the two-unit machine as well as the three-unit machine.

As shown in FIG. 1, the modular vacuum cleaning system of the present invention includes three units or pods which can be assembled in different combinations to provide wet and dry vacuuming capability or wet and dry vacuuming and wet extraction capability. The three-component units are: a vacuum waste recovery tank 11 for receiving wet and dry debris and liquid when vacuum suction is supplied to the tank 11 by vacuum head 12. The waste recovery tank 11 includes wheels 30 so that the units 11 and 12 can be mounted together to form a portable wet/dry vacuum cleaning system. The third unit is cleaning solution tank 13. This unit dispenses premixed cleaning solution under pressure to an applicator tool for pick up and delivery to the waste recovery tank 11. The cleaning solution tank 13 can be assembled with the first two units 11 and 12 to form a self-contained, portable vacuum cleaning machine having the capability to perform wet extraction cleaning as well as wet and dry vacuum cleaning. Alternatively, the cleaning solution tank 13 can be disassembled from the waste recovery tank 11 and the vacuum head 12 (i.e., from the two unit machine 20), but used in combination with the machine 20 to provide the same combination of wet/dry/wet extraction capability.

Figure 3:
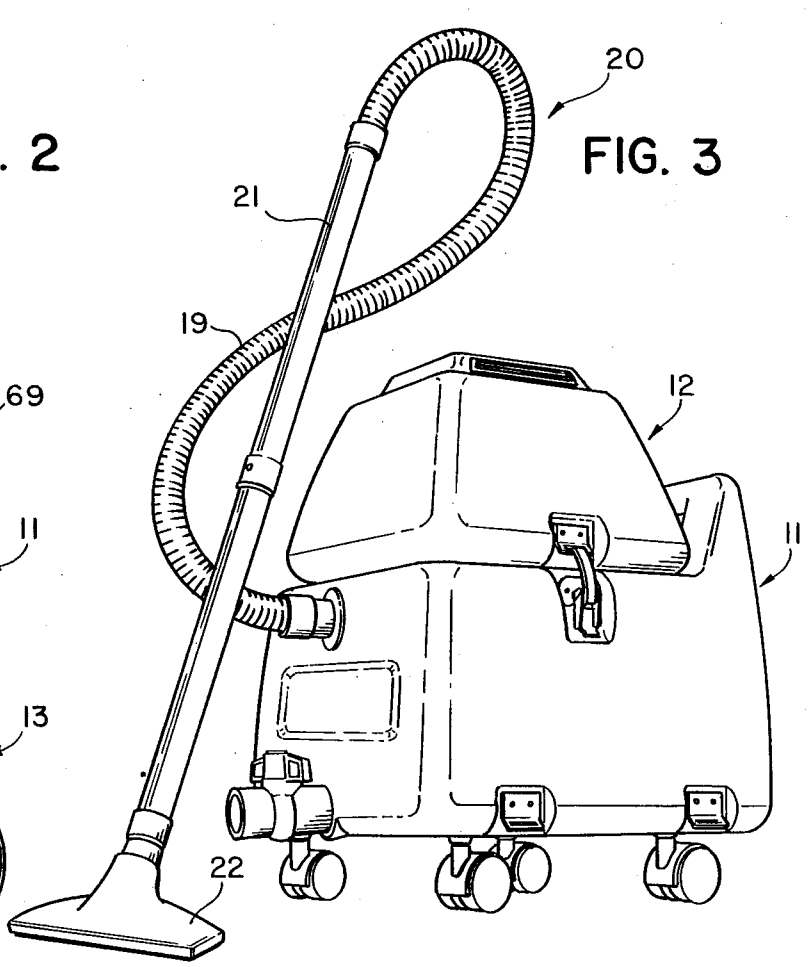
FIGS. 2 and 3 are perspective views of, respectively, the three-unit vacuum cleaning machine and the two-unit vacuum cleaning machine of the present invention.
Figure 2:
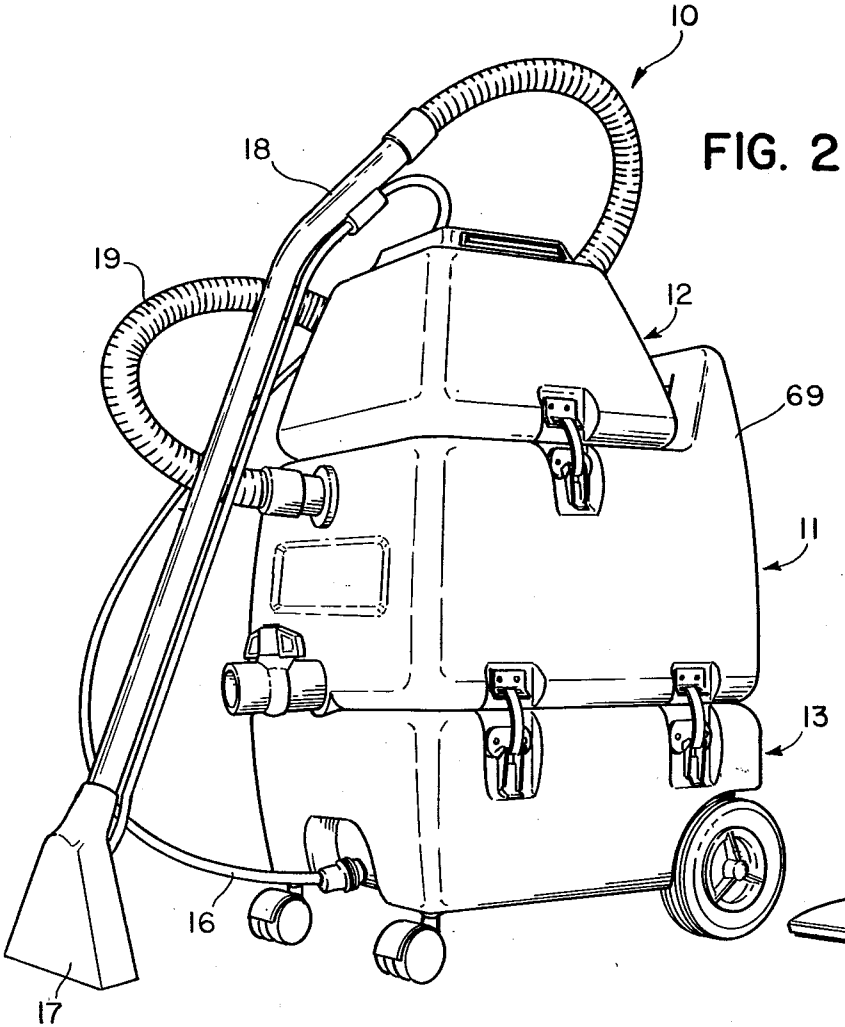

In short, the three units described above can be assembled and used (1) as a three-unit vacuum cleaning machine 10 (FIG. 2) having wet/dry vacuum and wet extraction cleaning capabilities; or (2) as a two-unit vacuum cleaning machine 20 (FIG. 3) having wet/dry vacuum capabilities; or (3) as a wet/dry/wet extraction machine in which the unit 20 (FIG. 2) and the cleaning solution tank 13 are used together although they are not mounted together.

Referring again to FIG. 2, during wet extraction operation of the three-unit machine 10, premixed cleaning solution or other liquid is dispensed under pressure from the cleaning solution tank 13 and flows through a cleaning solution hose 16 that is connected to the tank, to a spray nozzle or spray manifold on the head 17 of a hand-held applicator tool 18. The head also applies vacuum suction to the floor or other surface to pick up wet and dry debris and liquid and to transport the debris and liquid over vacuum hose 19 to the waste recovery tank 11. During operation of the wet/dry vacuum cleaning machine 20 shown in FIG. 2 (or of the machine 10), the vacuum hose 19 is connected to a conventional hand-held vacuuming tool 21. Here, the head 22 of the tool 21 is specifically designed for picking up wet and dry debris and liquid to transport the debris and liquid via vacuum hose 19 to the waste recovery tank 11. It should be mentioned that the hand-held applicator tools 18 and 21 are standard items which are widely available throughout the industry.

Cleaning Solution Tank 13

Figure 4:
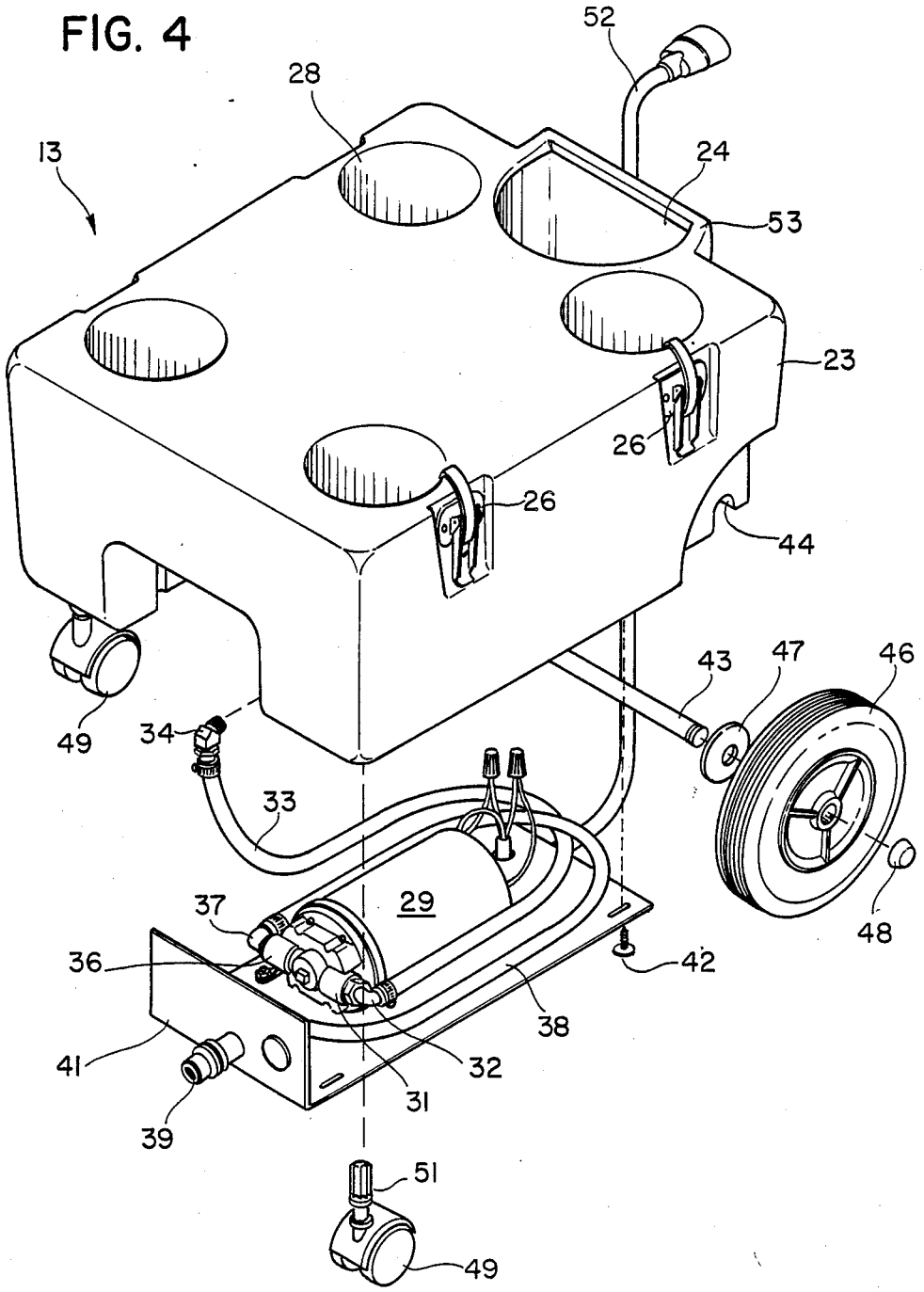
FIG. 4 is an exploded perspective view of a preferred embodiment of the cleaning solution storage and applicator tank of the present invention.

The construction of the cleaning solution tank is depicted in detail in the exploded view of FIG. 4. The tank 13 includes a tank body 23 which typically is formed of metal, or preferably, of lightweight sealed plastic material. Orifice 24 is formed at the top rear of the tank body for filling the tank with premixed cleaning solution and for emptying the tank after use. Two latches 26 are mounted on each side of the tank body 23 by screws for connecing to mating latch strike plates 27-27 (FIG. 5) on the waste recovery tank to mount the waste recovery tank 11 on the cleaning solution tank. The tank body 23 has four cutouts or, preferably, cupshaped depressions 28 formed in its upper surface for receiving the waste recovery tank wheels 30-30. This permits flush mounting of the waste recovery tank 11 on the cleaning solution tank.

The cleaning solution tank also mounts a liquid pump 29. The inlet 31 of the pump is connected by an elbow adapter 32 to a hose 33 that is coupled to an elbow 34. The elbow makes a threaded connection (not shown) to the bottom of the tank body 23. Cleaning solution is picked up by the pump 29 from the hose 38 and is dispensed under pressure via the outlet 36. The outlet is connected by an elbow adapter 37 to hose 38, which is coupled to a male quick disconnect coupler 39. The cleaning solution hose 16 (FIG. 2) is attached to the male coupler 39 for dispensing the cleaning solution under pressure to the applicator tool 18, as described previously.

The coupler 39 is mounted on an L-shaped base plate 41, which also mounts the pump 29. The base plate is attached to the underside of the tank body 23 by screws 42. The base plate 41 also supports wheel axle 43 within a groove 44 that is formed in the undercarriage of the tank body 23. A pair of wheels 46 are mounted to the opposite ends of the axle using a standard mounting arrangement such as washer 47 and axle cap 48. A second pair of wheels 49 are mounted at the front of the tank body 23. Presently, these are twin caster wheels having fluted top bearing assemblies 51 that are inserted into mounting bores (not shown) in the underside of the tank body 23. Also, a power supply cord 52 is connected to the pump 29 for operating the pump. Finally, the cleaning solution tank body 23 includes an integral lip or handle 53 which can be used to move the tank.

The above-described construction provides a cleaning solution tank that is a completely self-contained portable unit for holding cleaning solution or water or other liquid and dispensing the cleaning solution under pressure to an applicator tool. As mentioned, the cleaning solution tank can be used alone or can mount the waste recovery tank 11 and the assembled wet/dry vacuum cleaning machine 20 thereon. In a presently preferred embodiment, the tank body 53 is made of cross-linked polyethylene, which is lightweight, is chip resistance and is easily molded. The tank body is designed to hold approximately five gallons of solution. The pump 29 is a 55 psi internal by-pass diaphragm-type pump. However, as will be readily appreciated by those of skill in the art, other tank materials, tank capacities and pumps of different ratings can be used.

Recovery Tank 11

Figure 5:
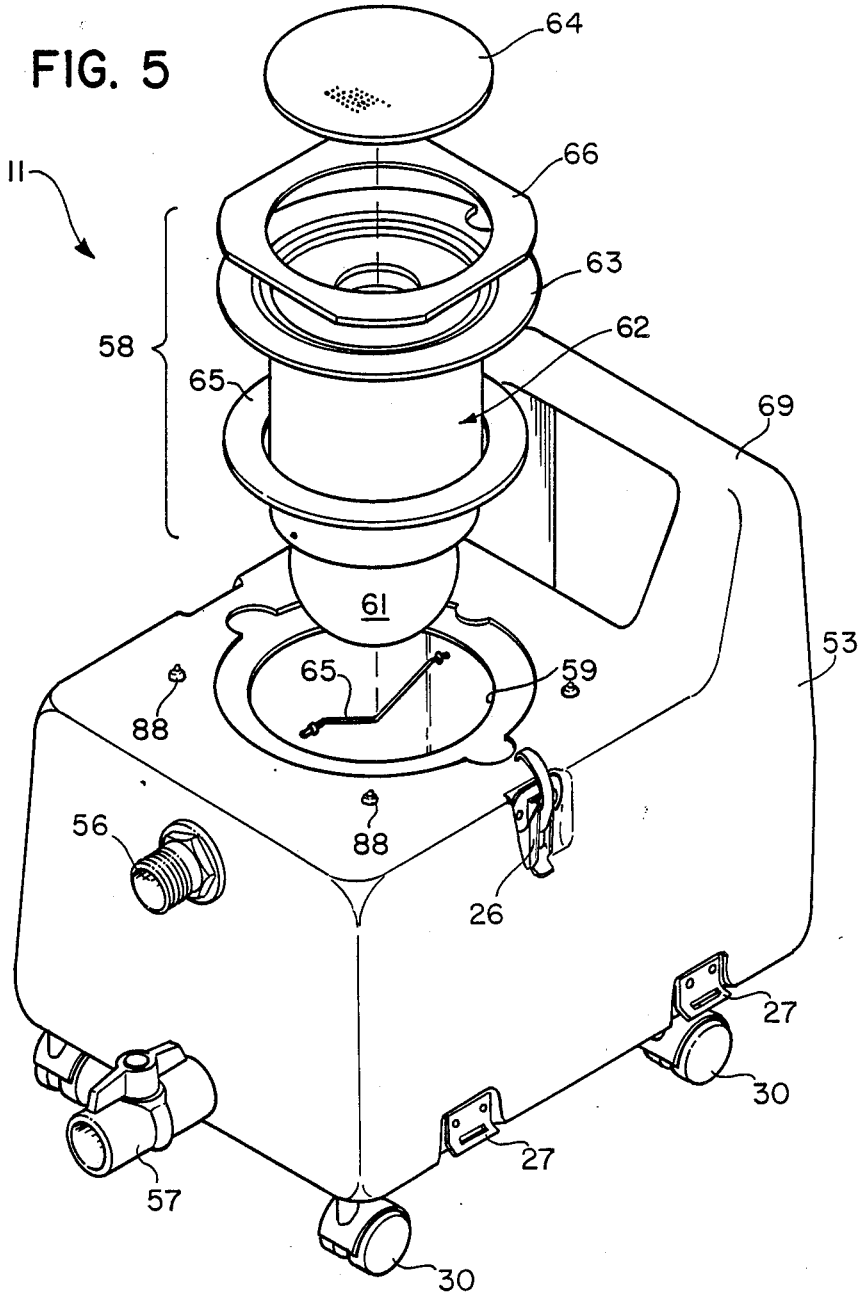
FIG. 5 is an exploded perspective view of a preferred embodiment of the waste recovery tank of the present invention.

Referring to FIG. 5, the recovery tank includes a tank body 53 which can be formed of the same material used to form the solution tank 23 (FIG. 4). As mentioned, the recovery tank 11 mounts latch strike plates 27 for assembling the tank with the cleaning solution tank 13. In addition, the tank body 53 mounts a pair of latches 26 on the opposite upper sides thereof which connect to latches 27 (FIG. 6) on the vacuum head 11 to mount the head to the cleaning solution tank. A male adapter assembly 56 is mounted to the upper front side of the tank body 53 and connects to the vacuum hose 19 (FIGS. 2 or 3) for depositing debris and liquid into the tank body 53. A dump valve 57, typically a valve ball assembly, is mounted to the lower front side of the tank body 53 for emptying the contents of the tank.

Stack assembly 58 shown in FIG. 5 is mounted within an orifice 59 in the upper surface of the recovery tank 53 by screws (not shown). The assembly 58 includes, in order, from bottom to top, a ball float 61 which is returned within the cylindrical filter pan assembly 62 by retainer rod 65. The filter pan assembly includes an upper flange 63 which sits on an annular filter gasket 65 and is mounted to the tank body 53 by screws (not shown). A circular screen filter 64 is seated within the flange 63 of the filter pan assembly and fits within the peripheral vacuum motor gasket 66. This filter 64 covers orifice 67 in the filter pan assembly. This orifice couples the interior of the tank body 53 to the vacuum head 12 so that that vacuum provided by the vacuum head draws debris and liquid through male adapter assembly 56 into the recovery tank body 53. Finally, the recovery tank body 53 includes an integral molded handle 69 for moving the two-pod vacuum tank 20 using wheels 30-30 and for moving the three-pod vacuum cleaning system 30 using the wheels 46 and 49.

In the present working embodiment, the recovery tank capacity is about seven gallons. Also, the float 61 seats against gasket 70 (FIG. 7) to automatically stop vacuum air flow when the water level in tank 53 reaches a predetermined level. Obviously, this prevents the recovery tank from overflowing. As mentioned previously, the recovery tank body can be formed of the same material such as cross-linked polyethylene which forms the cleaning solution tank body 23.

Vacuum Head 12

Figure 6:
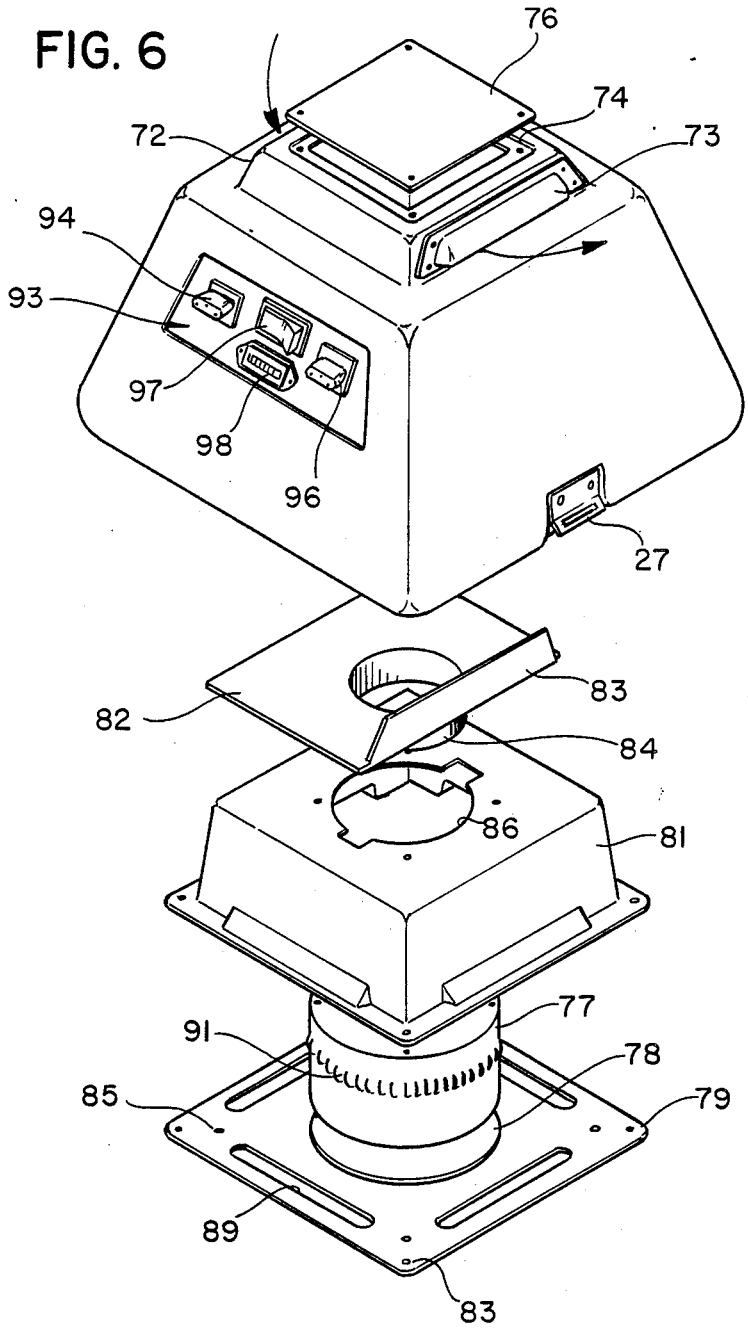
FIG. 6 is an exploded perspective view of a preferred embodiment of the vacuum head of the present invention.
Figure 7:
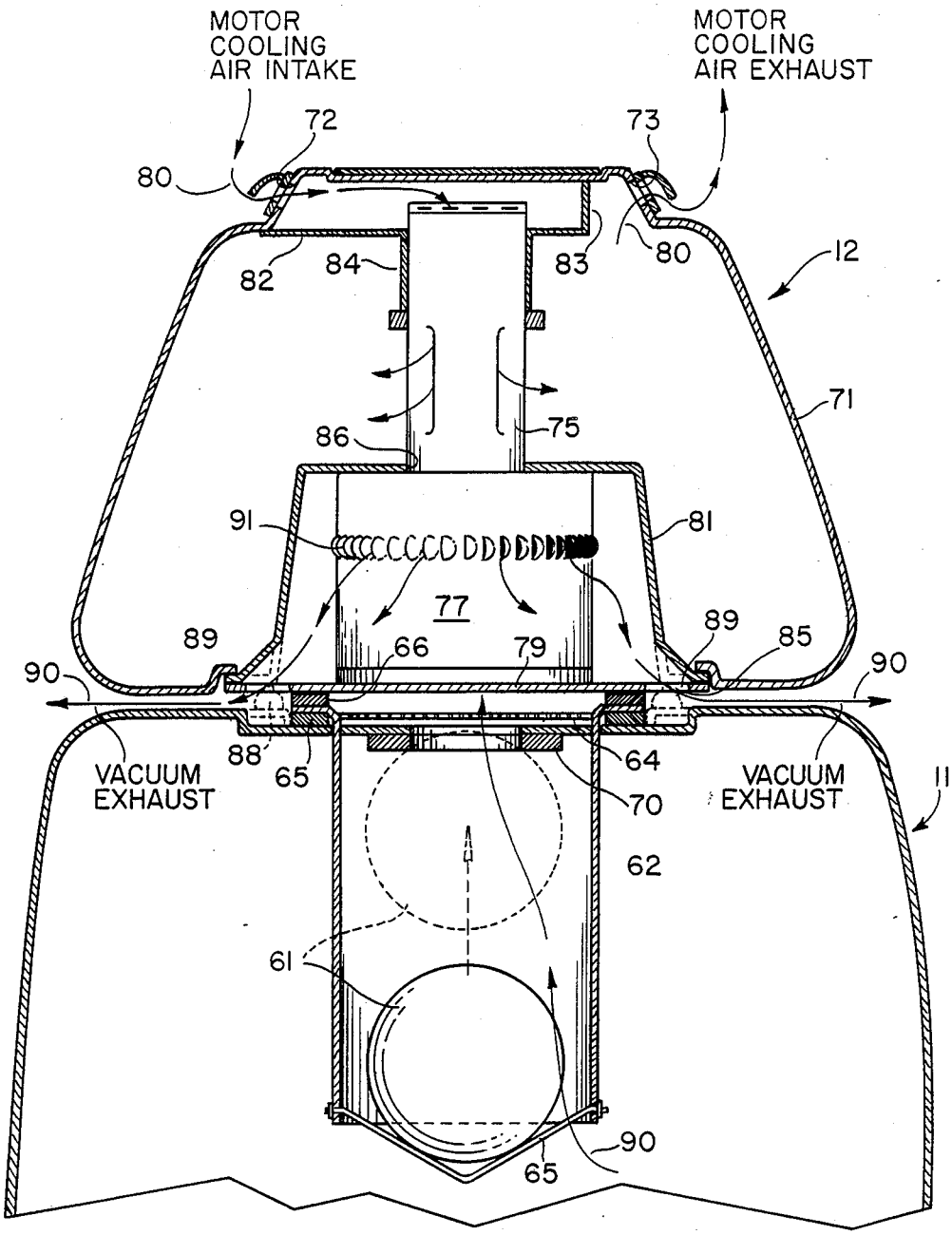
FIG. 7 is a cross-sectional view of a preferred embodiment of the vacuum head of the present invention.

Referring to FIGS. 6 and 7, the vacuum head 12 includes a housing 71 that can be formed of the same material used to form the two tanks. Louvered cooling air inlet and exhaust openings 72 and 73 are formed in opposite sides at the top of the shell 21. An access opening 74 and cover plate 76 are also provided at the top shell.

A peripheral discharge vacuum motor and blower unit 77 is mounted over gasket 78 to a mounting plate 79. As shown in FIG. 7, a cooling fan 75 is mounted on the unit 77 (or is constructed as a unit with unit 77). A vacuum motor divider box 81 is also attached to the mounting plate 79 by screws (not shown). An L-shaped divider plate 82 is attached to the upper interior of the shell 71 by screws (not shown) or by a press fit. The divider plate flange 83 separates the air flow of the inlet and exhaust louvers 72 and 73. The cooling fan 75 extends through the hole 86 in the divider box 81 and also through the neck 84 in the divider plate 82. Thus, as shown by air flow path 80 in FIG. 7, cooling air enters the vaccum head at louvered opening 72 and is blown by fan 75 internally over the vacuum motor, then is channeled by flange 83 to the exhaust opening 73.

The construction of vacuum head 12 also provides vacuum air flow which is separate from the cooling air flow. The mounting plate 79 is used to mount the unitized vacuum blower assembly to a correspondingly shaped orifice in the base of the shell 71 by screws (not shown) using the apertures 83 in the mounting plate. Alignment holes 85 in the mounting plate fit into corresponding stand-offs 88 (FIG. 5) on the top of the recovery tank to space the bottom of the vacuum shell 71 from the recovery tank when the vacuum head 71 is mounted on the recovery tank. This spacing permits the vacuum air flow to be exhausted through apertures 89 in the mounting plate 79.

The vacuum air flow path 90 is shown in FIG. 7. Air flows from the waste recovery tank 11 into the base of the vacuum blower and out the vanes 91 in a peripheral discharge. Box 81 (which separates the vacuum air flow from the cooling air flow) directs the discharged air through the slots 89 and out of the vacuum head 12.

As mentioned, the shell 71 of the vacuum head can be formed of the same material such as cross-linked polyethylene used to form the two tanks. In a presently preferred working embodiment, the vacuum blower 77 uses a two-stage 3.1 (peak) horsepower vacuum motor which provides 96 inches water lift (sealed) at sea level and 114 cfm air flow with a two inch orifice. Power is supplied to the vacuum motor via an electrical control panel 93 and internal wiring (not shown). Receptacle 94 connects the vacuum blower unit 77 via a power cord to standard 115 volt ac, 60 Hz outlet. Receptacle 96 is connected to the receptacle 94 to supply power via cord 52 (FIG. 4) to the cleaning solution pump 29. Thus, the single rocker switch 97 can be used to control the on/-off operation of the pump 29 as well as the vacuum blower unit 77. Optionally, a standard five digit usage meter 98 is included in the control panel.

Having thus described preferred and alternative embodiments of my two-pod/three-pod vacuum cleaning system, what is claimed is:

1. Components or pods for selectively forming a two-pod vacuum machine and a three-pod wet extraction vacuum machine, comprising:

a first pod comprising: a recovery tank, having an orifice and including valve means for emptying the tank; a vacuum inlet connector for directing debris and liquid into the recovery tank during the application of vacuum to the recovery tank; float means mounted within the orifice for selectively closing the orifice in response to the level of liquid within the recovery tank; filter means mounted to the orifice over the float means; and means mounted in the bottom of said recovery tank for moving the first pod along a floor surface;

a second pod comprising: a vacuum head, including a vacuum blower means having a vacuum inlet adapted for connection to the orifice of the recovery tank to apply vacuum suction to the recovery tank;

a third pod comprising: a cleaning solution application tank, including a pump and a pump outlet for dispensing cleaning solution under pressure, and means mounted on the bottom of said third pod for moving said third pod along a floor surface; and the first, second and third pods being adapted for selectively and releasably mounting together the second pod on the first pod and the first pod on the third pod to provide a vacuum cleaning machine selected from the first and second pods and all three pods;

the vacuum blower means including a vacuum blower having an air outlet, an air inlet adopted for connection to the recovery tank and a cooling fan mounted on the vacuum blower having an upper air inlet and a lower air exhaust; and wherein the vacuum head further comprises: (a) cooling air inlet and outlet openings in the top of the head and at least one vacuum air flow exhaust outlet in the bottom thereof; (b) an enclosure surrounding the vacuum blower for directing discharge air to the vacuum air flow exhaust opening and (c) a second enclosure connecting the cooling air inlet of the vacuum head and the fan cooling air inlet and separating the vacuum head cooling air inlet and the fan cooling air inlet from the vacuum head cooling air outlet, to thereby define separate vacuum air flow and cooling air flow paths within the vacuum head.

2. A three-pod vacuum machine, comprising:

a first pod comprising: a recovery tank, having an orifice and including valve means for emptying the tank; a vacuum inlet connector for directing debris and liquid into the recovery tank during the application of vacuum to the recovery tank; float means mounted within the orifice for selectively closing the orifice in response to the level of liquid within the recovery tank; filter means mounted to the orifice over the float means; and means for permitting movement of the recovery tank along a floor;

a second pod comprising: a vacuum head, including vacuum blower means having a vacuum inlet adapted for connection to the orifice of the recovery tank to apply vacuum suction to the recovery tank;

a third pod comprising: a cleaning solution application tank, including a pump and a pump outlet for dispensing cleaning solution under pressure, and means such as wheels for permitting movement of the tank; and the first, second and third pods being adapted for cooperatively and releasably mounting the second pod on the first pod and the first pod on the third pod to provide an arrangement selected from the first and second pods and all three pods.

3. A three-pod vacuum machine, comprising:

a first pod comprising: a recovery tank; having an orifice and including valve means for emptying the tank; a vacuum inlet connector for directing debris and liquid into the recovery tank during the application of vacuum to the recovery tank; float means mounted within the orifice for selectively closing the orifice in response to the level of liquid within the recovery tank; filter means mounted to the orifice over the float means; and means for permitting movement of the recovery tank along a floor;

a second pod comprising: a vacuum head, including a vacuum blower means including a peripheral discharge blower having an air inlet adapted for connection to the orifice of the recovery tank to apply vacuum suction to the recovery tank; a cooling fan mounted on the vacuum blower and having an upper air inlet and a lower air exhaust; the vacuum head further comprising: (a) cooling air inlet and outlet openings in the top of the head and at least one vacuum air flow exhaust outlet in the bottom thereof; (b) an enclosure surrounding the vacuum blower for directing peripheral discharge air to the vacuum air flow exhaust opening; and (c) a second enclosure connecting the cooling air inlet of the vacuum head and the fan cooling air inlet and separating the vacuum head cooling air inlet and the fan cooling air inlet from the vacuum head cooling air outlet, to thereby define separate vacuum air flow and cooling air flow paths within the vacuum head;

a third pod comprising: a cleaning solution application tank, including a pump and a pump outlet for dispensing cleaning solution under pressure, and means such as wheels for permitting movement of the tank;

the first, second and third pods being adapted for cooperatively and releasably mounting the second pod on the first pod and the first pod on the third pod to provide an arrangement selected from the first and second pods and all three pods.

* * * * *